United States Patent [19]

Zygutis

[11] Patent Number: 4,850,800

[45] Date of Patent: Jul. 25, 1989

[54] DEVICE FOR BLOCKING ROTATION OF MARINE PROPELLERS

[76] Inventor: Larry Zygutis, 2434 S. Eleventh Ave., Phoenix, Ariz. 85007

[21] Appl. No.: 300,491

[22] Filed: Jan. 23, 1989

[51] Int. Cl.[4] ..... B63H 21/26

[52] U.S. Cl. ..... 416/146 R; 416/62; 440/74

[58] Field of Search ..... 416/146 B, 62, 244 B, 416/247 A; 440/49, 74, 113

[56] References Cited

U.S. PATENT DOCUMENTS

| | | | |
|---|---|---|---|
| 2,486,672 | 11/1949 | Notestein . | |
| 3,981,165 | 4/1976 | Wersinger | 70/232 |
| 3,981,617 | 9/1976 | Milewicz | 416/244 B |
| 4,564,991 | 1/1986 | Taylor | 29/426.5 |
| 4,624,644 | 11/1986 | Hall | 440/49 |
| 4,645,422 | 2/1987 | Brushaber | 416/93 A |
| 4,715,783 | 12/1987 | Wade | 416/146 R |

*Primary Examiner*—Everette A. Powell, Jr.

[57] ABSTRACT

An improved device for blocking the rotation of marine propellers on lower units of outboards or out-drives is described. The blocking unit has a fixed part and a movable clamp. The fixed part is held by the movable clamp against the under side of the anti-cavitation plate of the lower unit and has a height sufficient to extend down into the propeller rotation circle. When torque is applied to the propeller retaining nut a propeller blade engages the side or bottom of the fixed part and the propeller is prevented from rotating. The blocking unit has an enriching flange and central and transverse webs to provide a low stress design so that it may be fabricated of plastic.

17 Claims, 2 Drawing Sheets

DEVICE FOR BLOCKING ROTATION OF MARINE PROPELLERS

BACKGROUND OF THE INVENTION

1. Field of the Invention

This invention concerns means and methods for blocking the rotation of marine propellers and, more particularly, apparatus and techniques for preventing rotation of propellers on outboard motors and outdrive units of inboard-outboard marine propulsion systems to facilitate removal and installation of such propellers.

2. Background Art

Outboard motors are manufactured in sizes ranging from about one horsepower to several hundred horsepower. Inboard-outboard propulsion systems have even higher power ratings. A common feature of both outboard motors and inboard-outboard propulsion systems is that the propeller is mounted on a submersible lower unit which extends into the water from the transom of the boat and which turns in response to the steering linkage to direct the thrust of the propeller partly to the port or starboard in order to steer the vessel.

The outdrive portion of an inboard-outboard propulsion system and the lower unit of an outboard motor are structurally similar in several respects. Both have a substantially horizontal anti-cavitation plate mounted above the propeller, both have a gear box to couple the substantially vertical internal drive shaft to the substantially horizontal propeller shaft, both have a skeg or other protrusion below the propeller to protect the propeller from obstacles on the bottom, and both have removable propellers. Frequently, both have an outlet for engine exhaust gases extending through the propeller hub, but this and other internal construction details of the lower unit portion of the outboard motor or inboard-outboard drive are not of interest to the present invention. As used herein, the words "lower unit" are intended to include both outboard motor lower units and inboard-outboard drive lower units which are submersible and have anti-cavitation plates extending over removable propellers.

The drive shaft of a typical lower unit passes through the axis of rotation of the propeller. The propeller is coupled to the drive shaft by a shearable pin or friction device so that the rotational energy of the drive shaft is transmitted to the propeller. Typically, the propeller is retained on the drive shaft by a washer and locking nut on the end of the drive shaft. In order to remove the propeller, it is necessary to unscrew the retaining nut or other propeller locking means. Depending on how long the nut has been mounted on the propeller shaft, a large torque may be required in order to break it loose. This is especially true with high horsepower units having large propellers and correspondingly large propeller shafts and retaining nuts.

In many situations, the internal gears of the lower unit cannot be used to immobilize the propeller shaft while one attempts to remove or tighten the retaining nut. Thus, a continuing need exists for improved means and methods for preventing the propeller from rotating while torque is applied to remove the propeller retaining nut. In the past it has been customary to wedge a tool or piece of wood between the propeller and the anti-cavitation plate, but such methods are not reliable, especially when the required torque is large. Slippage and injury often result.

A prior art attempt to solve this problem is described in U.S. Pat. No. 4,624,644 in which a propeller blocking unit is obtained by sliding a specially shaped hollow structure over the anti-cavitation plate. Because lower units from different manufacturers and of different horsepower rating have very different anti-cavitation plate designs, a service technician would be required to stock a substantial number of such blocking units of different shape and dimensions. This is not desirable.

Accordingly, it is an object of the present invention to provide an improved means and method for blocking the rotation of marine propellers on marine lower units to facilitate removal of the propeller retaining nut or other propeller retaining mechanism.

It is a further object of the present invention to provide such improved means and method in a simple and effective manner that is less prone to slippage than prior art methods.

It is a still further object of the present invention to provide such improved means which is adapted to fit on lower units of different manufacturers and of a wide range of power ratings.

It is an additional object of the present invention to provide such improved means of comparatively inexpensive materials that are light weight, durable and able to block the propeller against light torques.

SUMMARY OF THE INVENTION

The above and other objects and advantages are achieved by the the present invention wherein there is provided a propeller blocking device for use with lower units having an anti-cavitation plate, comprising, a fixed propeller blocking means for interfering with the rotation of the propeller and a movable clamping means coupled to the fixed blocking means for clamping the fixed blocking means against the anti-cavitation plate. The blocking means has first and second parts separated by a gap of predetermined width adapted to engage the anti-cavitation plate and connected at an end of the gap by a third part extending between the first and second parts. The first part desirably has an opening therein for receiving the movable clamping means.

In a preferred embodiment, the fixed blocking means has a stiffening flange extending externally around the first, second and third parts, a central first web transverse to the flange and aligned with the movable clamping means and extending through the first, second and third parts, and a second web in the second part transverse to the first web and the flange and aligned to intersect the first web under the movable clamping means. The second web is also desirably aligned with the movable clamping means.

These and other advantages and objects will be more fully appreciated by considering the description that follows together with the accompanying figures.

DETAILED DESCRIPTION OF THE FIGURES

Figure 1:
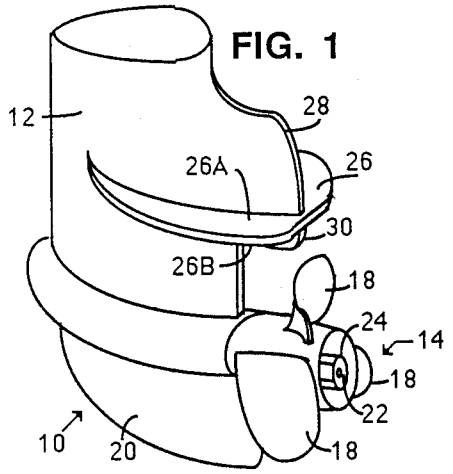
FIG. 1 is a perspective view of the submersible portion of an outboard marine engine or inboard-outboard propulsion system generally referred to as a "lower unit".

FIG. 1 shows a perspective view of marine lower unit 10 comprising column 12 for housing the drive shaft and gears and with propeller 14 on hub 16 with blades 18. Propeller 14 is retained on horizontal drive shaft 22 by axially mounted retaining mechanism 24, usually a nut.

Below propeller 14 is skeg 20. Above propeller 14 are generally found vertical fins 28, 30 and horizontal anti-cavitation plate 26. While different lower units may differ in detail, for the purposes of this invention it is only important that they have anti-cavitation plate 26 or equivalent above (or beneath) propeller 14 and extending in a fore and aft direction past propeller 14. Anti-cavitation plate 26 has upper surface 26A and lower surface 26B.

Figure 3:
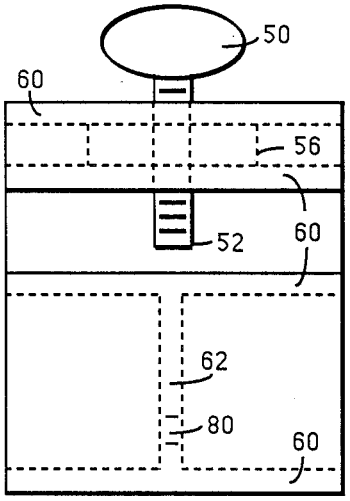
FIG. 3 is a front view of the blocking unit of FIG. 2.
Figure 2:
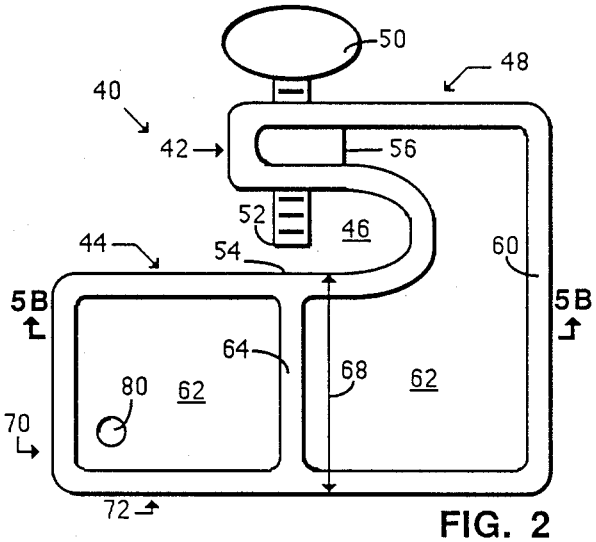
FIG. 2 is a side view of the propeller blocking unit of the present invention according to a preferred embodiment.
Figure 4:
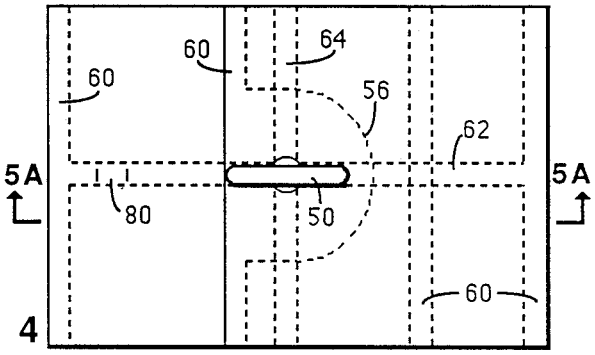
FIG. 4 is a top view of the blocking unit of FIG. 2.
Figure 5B:
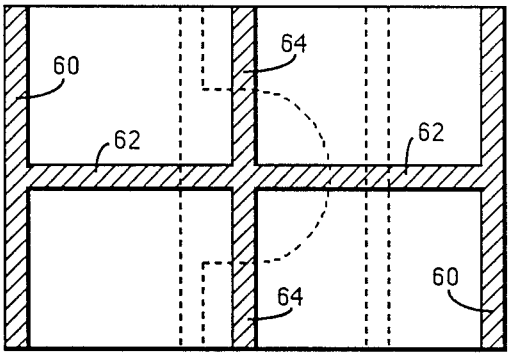

FIG. 2 shows a side view, FIG. 3 shows a front view and FIG. 4 shows a top view of propeller blocking unit 40 according to a preferred embodiment of the present invention. Further understanding is also provided by cross-sectional views 5A–B.

Referring now to FIGS. 2–5, blocking unit 40 has first portion 42 containing movable clamping means 50, for example a thumb screw, with portion 52 for pressing on upper surface 26A of anti-cavitation plate 26. Thickened part 56 is provided in first portion 42 to accommodate the threads on the thumb screw, e.g., clamping means 50.

Blocking unit 40 has second portion 44 with upper surface 54 for engaging lower surface 26B of anti-cavitation plate 26. Slot 46 between first portion 42 and second portion 44 is provided to accommodate anti-cavitation plate 26. First and second portions 42 and 44 are connected by rigid coupling means 48.

While movable clamping means 50 has been illustrated in the form of a thumb screw, those of skill in the art will appreciate that other releasable clamping means, such as for example, a cam or wedge could also be used. Any mechanism for locking block 44 firmly against anti-cavitation plate 26 is suitable. While locking may be accomplished by forcing either upper portion 42 or lower portion 44 against anti-cavitation plate 26, it is preferred to force lower portion 44 against anti-cavitation plate 26 since propeller blades 18 bear against lower portion 44 and this arrangement provides greater stability.

Blocking unit 40 preferably has flange 60 extending substantially around the entire perimeter of unit 40. Flange 60 is supported by central web 62, preferably aligned with clamping means 50. Flange 60 and web 62 are conveniently perpendicular. These features are particular illustrated in cross-sections 5A–B.

Transverse web 64 is also provided extending between opposed portions of flange 60 and intersecting central web 62, preferably under clamping means 50. Webs 62 and 64 are conveniently perpendicular. Hole 80 is conveniently provided in webs 62, 64 or flange 60 for storing the unit. While hole 80 is illustrated as being in web 62, it may be elsewhere.

Figure 6A:
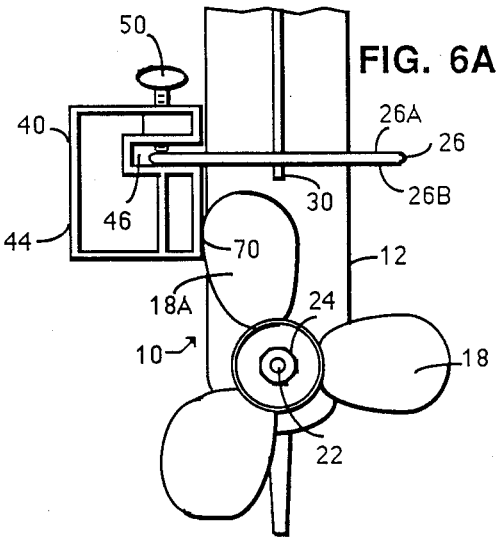
FIGS. 6A–B are rear elevation views of a lower unit showing the blocking unit of the present invention installed thereon.
Figure 7:
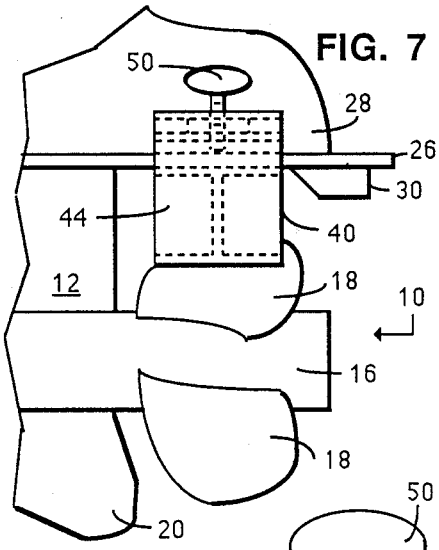
FIG. 7 is a side view a lower unit showing the blocking unit of the present invention installed thereon.
Figure 6B:
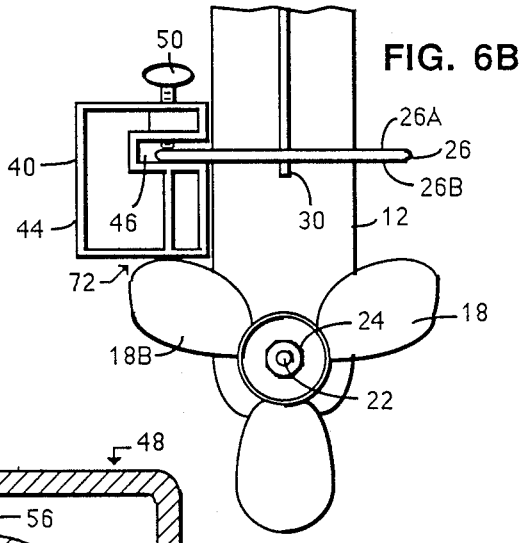
Figure 5A:
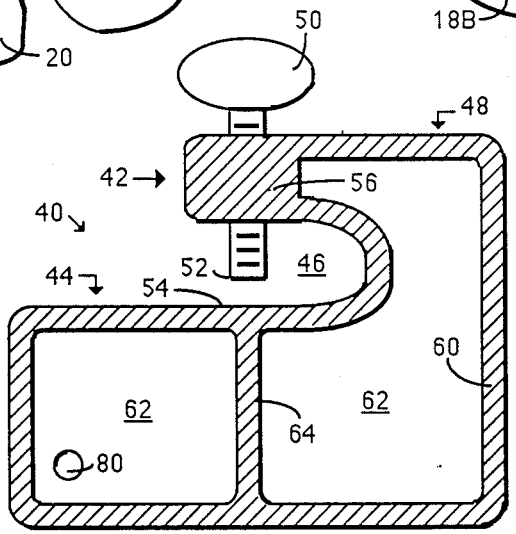
FIGS. 5A–B are cross-sectional views of the blocking unit of FIG. 2 at locations indicated on FIGS. 2 and 4.

The use of blocking unit 40 for blocking rotation of a marine propeller on a lower unit is illustrated in FIGS. 6A–B and 7. FIGS. 6A–B are rear elevation views of lower unit 10 with blocking unit 40 mounted thereon. Blocking unit 40 is installed on anti-cavitation plate 26 so that slot 46 of unit 40 engages anti-cavitation plate 26 and unit 40 is held rigidly in place by releasable clamp means 50.

FIG. 6A illustrates the situation where unit 40 is placed on the left side of anti-cavitation plate 26 so that lower portion 44 of unit 40 blocks blade 18A from counter-clockwise rotation and FIG. 6B illustrates the situation, also on the left side of anti-cavitation plate 26, where lower portion 44 of unit 40 blocks blade 18B from clockwise rotation. Those of skill in the art will appreciate that by placing unit 40 on the right side of anti-cavitation plate 26 the direction of blocked rotation would be reversed. The desired direction of blocked rotation depends upon whether the propeller locking nut is being removed or installed and whether the locking nut threads are left handed or right handed. Unit 40 permits either direction of rotation to be blocked.

It will be appreciated, based on the explanation herein, that the arrangement of FIG. 6B is preferred, since propeller blade 18B bears against lower surface 72 (see FIG. 2) of unit 40 rather than against side 70 (see FIG. 2), as shown by blade 18A in FIG. 6A. By having propeller blade 18 bear against bottom 72, lower portion 44 of unit 40 is forced more firmly against anticavitation plate 26 by the applied torque and therefore slippage is less likely. Thus, the arrangement of FIG. 6B with unit 40 on the left side of anti-cavitation plate 26 should be used for applying clockwise torque to nut 24 and the complementary arrangement with unit 40 on the right side of anti-cavitation plate 26 used for applying counterclockwise torque on nut 24.

Unit 40 may be conveniently fabricated of metal or plastic. Steel, aluminum, brass, and various castable aluminum alloys are examples of suitable metals. Epoxy and phenolic are examples of suitable plastics although other commercial grade high strength plastics well known in the art may also be used. Plastic is preferred because it is lighter, easily cast or injection molded, and generally less expensive than metal.

A particular feature of the invented design is that, even though large torques are applied to the propeller nut, the torque is transmitted to the anti-cavitation plate without excessive stress, particularly excessive tensile stress, being developed in any part of the blocking unit. This permits the blocking unit to be fabricated of comparatively inexpensive low strength materials, such as for example plastics or pot metal, rather than steel, iron or high strength alloys.

Those of skill in the art will appreciate that the invented unit provides an improved means and method for blocking rotation of marine propellers that is simultaneously effective, simple to use, durable, light weight, inexpensive to manufacture and adaptable to a wide range of lower unit sizes and designs without requiring a large number of different versions. In particular, gap 46 may be made large enough to engage anti-cavitation plate 26 and height 68 large enough to extend from lower surface 26B of anti-cavitation plate 26 to within the propeller rotation circle of lower units of many different sizes and styles so that their propellers can all be blocked by a single size unit. Because movable clamp means 50 is adjustable, a wide range of anticavitation plate sizes and thicknesses and propeller sizes can be accommodated. Thus, a wide range of horsepower ratings and lower unit designs can be accommodated with only one or at most a very few sizes of the invented blocking unit.

Having described the invention, it will be appreciated by those of skill in the art that, based on the teachings herein, numerous modification may be made without departing from the spirit of the invention. Accordingly, it is intended to include all such equivalents and modifications in the claims that follow.

I claim:

1. A propeller blocking unit for attachment to an anticavitation plate of a marine lower unit, comprising:

fixed propeller blocking means for interfering with the rotation of the propeller;

movable clamping means coupled to the blocking means for clamping the fixed blocking means against the anti-cavitation plate; and wherein the blocking means has first and second parts separated by a gap adapted to engage the anti-cavitation plate and connected at an end of the gap by a third part extending between the first and second parts, and wherein the first part has an opening therein for receiving the movable clamping means.

2. The unit of claim 1 wherein the fixed clamping means comprises, a flange extending externally around the first, second and third parts, a first web transverse to the flange and aligned with the movable clamping means and extending through the first, second and third parts, and a second web in the second part, transverse to the first web and the flange means, and aligned to intersect the first web under the movable clamping means.

3. The unit of claim 2 wherein the second web is aligned with the movable clamp means.

4. The unit of claim 2 wherein the movable clamp means comprises a screw for rotationally engaging a threaded hole in the first part and extending into the gap.

5. A propeller stop device for attachment to an outboard marine propulsion with a submersible column which includes a projecting fin having a side facing a propeller and located a predetermined distance from the rotation circle of the propeller, wherein the propeller is mounted on a drive shaft extending from the submersible column and retained on the drive shaft by a retaining means, comprising:

a rigid stop member having a height exceeding the predetermined distance for blocking rotation of the propeller; and movable clamp means coupled to the stop member for detachably securing the stop member to the side of the projecting fin facing the propeller.

6. The device of claim 5 wherein the rigid stop member comprises a first portion for passing over part of a first face of the projecting fin, a second portion for detachably engaging a second, opposite face of the the projecting fin and extending into interference with the rotation of the propeller, and a third portion rigidly connecting the first and second portions.

7. The device of claim 6 wherein the movable clamp means comprises a clamp passing through a hole in the first portion for drawing the first portion away from the first face of the fin and pressing the second portion against the second face of the fin.

8. The device of claim 5 wherein the stop member has a perimeter and further comprising a flange passing substantially continuously around the perimeter and a first web substantially transverse to the flange and centrally located therein.

9. The device of claim 8 further comprising a second web extending between opposed portions of the flange and transverse to the first web and aligned under the movable clamp means.

10. The device of claim 5 wherein the rigid stop member has a flange for contacting the projecting fin and a central web oriented perpendicular to the flange and located beneath the clamp means.

11. The device of claim 10 wherein the flange extends substantially around a perimeter of the central web.

12. The device of claim 11 further comprising a supporting web intersecting the central web under the clamp means and extending from one portion of the flange to another opposed portion of the flange.

13. The device of claim 12 wherein the supporting web is substantially perpendicular to the central web.

14. The device of claim 13 wherein the supporting web is substantially perpendicular to the flange.

15. The device of claim 6 wherein the clamp means comprises a screw clamp extending through a threaded aperture in the first portion toward the second portion.

16. The device of claim 6 wherein the clamp means comprises a movable cam means for pressing against the first face of the fin and forcing the second portion into engagement with the second face of the fin.

17. The device of claim 5 wherein the clamp means comprises a rotating means for clamping a first portion of the stop member against a first face of the fin.

* * * * *